US006662494B2

(12) United States Patent
Weder et al.

(10) Patent No.: US 6,662,494 B2
(45) **Date of Patent: *Dec. 16, 2003**

(54) SYSTEM FOR FORMING A DECORATIVE COVER FOR A PLANT HAVING SUBSTANTIAL HORIZONTAL GROWTH

(75) Inventors: Donald E. Weder, Highland, IL (US); Michael J. King, Highland, IL (US)

(73) Assignee: Southpac Trust International, Inc., Highland, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/263,487

(22) Filed: Oct. 2, 2002

(65) Prior Publication Data

US 2003/0029085 A1 Feb. 13, 2003

Related U.S. Application Data

(63) Continuation of application No. 09/859,954, filed on May 17, 2001, now Pat. No. 6,523,303.
(60) Provisional application No. 60/207,594, filed on May 26, 2000.

(51) Int. Cl.[7] ..... A47G 7/08
(52) U.S. Cl. ..... 47/72
(58) Field of Search ..... 47/72, 41.01

(56) References Cited

U.S. PATENT DOCUMENTS

| | | | | | |
|---|---|---|---|---|---|
| D56,308 | S | * | 9/1920 | Porter | D9/329 |
| D79,415 | S | * | 9/1929 | Arthur | D11/117 |
| 2,005,467 | A | * | 6/1935 | Menge | 47/41.11 |
| 2,894,358 | A | * | 7/1959 | Ward | 47/70 |
| 3,576,699 | A | * | 4/1971 | Meyer | 206/423 |
| 4,216,620 | A | | 8/1980 | Weder et al. | |
| 4,773,182 | A | * | 9/1988 | Weder et al. | 47/72 |
| 4,835,834 | A | | 6/1989 | Weder | |
| 4,950,216 | A | * | 8/1990 | Weder | 493/162 |
| 4,980,209 | A | | 12/1990 | Hill | |
| 5,077,937 | A | | 1/1992 | Weder et al. | |
| 5,339,565 | A | | 8/1994 | Weder et al. | |
| 5,349,739 | A | | 9/1994 | Weder | |
| 5,427,240 | A | | 6/1995 | Holtkamp, Jr. | |
| D362,648 | S | * | 9/1995 | Weder | D11/164 |
| 5,501,039 | A | | 3/1996 | Weder et al. | |
| 5,562,210 | A | * | 10/1996 | Weder et al. | 206/473 |
| 5,624,320 | A | * | 4/1997 | Martinez | 472/51 |
| D386,718 | S | * | 11/1997 | Weder et al. | D11/164 |
| D387,011 | S | * | 12/1997 | Weder et al. | D11/164 |
| D387,306 | S | * | 12/1997 | Weder et al. | D11/164 |
| 5,704,162 | A | | 1/1998 | Holtkamp, Jr. | |
| D392,918 | S | * | 3/1998 | Weder et al. | D11/164 |
| 5,860,249 | A | | 1/1999 | Holtkamp, Jr. | |
| 5,937,576 | A | | 8/1999 | Weder et al. | |
| 5,987,849 | A | | 11/1999 | Weder | |
| 6,006,472 | A | | 12/1999 | Holtkamp, Jr. | |
| 6,009,665 | A | | 1/2000 | Weder | |
| 6,115,961 | A | | 9/2000 | Shea | |
| 6,131,735 | A | | 10/2000 | Holtkamp, Jr. | |
| D463,321 | S | * | 9/2002 | Remke | D11/149 |
| 2002/0000065 | A1 | | 1/2002 | Weder et al. | |

* cited by examiner

*Primary Examiner*—Peter M. Poon
*Assistant Examiner*—Jeffrey L. Gellner
(74) *Attorney, Agent, or Firm*—Dunlap Codding & Rogers, P.C.

(57) ABSTRACT

A decorative cover for use with a plant having substantial horizontal growth is provided, as well as methods of making and using same. The decorative cover includes a base in which the plant can be disposed and a decorative border connected to and extending from the base. The decorative border has a curvilinear, undulating configuration which permits the decorative border to hold, support and cushion individual leaves and petioles of the plant to prevent damage thereto and to accommodate horizontal growth of the leaves and petioles of the plant.

4 Claims, 4 Drawing Sheets

SYSTEM FOR FORMING A DECORATIVE COVER FOR A PLANT HAVING SUBSTANTIAL HORIZONTAL GROWTH

CROSS-REFERENCE TO RELATED APPLICATIONS

This application is a continuation of U.S. Ser. No. 09/859,954, filed May 17, 2001 now U.S. Pat. No. 6,523,303; which claims benefit under 35 U.S.C. 119(e) of provisional application U.S. Serial No. 60/207,594, filed May 26, 2000.

STATEMENT REGARDING FEDERALLY SPONSORED RESEARCH OR DEVELOPMENT

Not Applicable.

BACKGROUND OF THE INVENTION

1. Field of the Invention

This invention relates generally to decorative flower pot covers used to cover pots or containers containing plants, and more particularly, but not by way of limitation, to decorative flower pot covers used to cover pots or containers containing plants having substantial horizontal growth, such as, but not by way of limitation, gesneriads such as African violets, as well as the systems utilized to form such decorative flower pot covers, and the methods of using same.

2. Brief Description of the Art

Flower pot covers, also called decorative covers, have been used to decoratively cover a pot or container holding a plant for a number of years. Some flower pot covers, as well as the apparatus and methods used in their construction, are disclosed in U.S. Pat. No. 4,773,182, entitled "Article Forming System", issued to Weder et al on Sep. 27, 1988, which is hereby expressly incorporated herein by reference.

These decorative covers have been used to cover and hide the pot, and to act as a decorative wrap to make the present of a potted plant more festive. However, the decorative covers described above do not function well when used with plants having substantial horizontal growth, such as gesneriads, and in particular, African violets. Such plants grow much differently than other plants and therefore have different vulnerabilities. Gesneriads frequently are very delicate, and the underneath side of the leaves and petioles may be damaged by the decorative covers of the prior art. Such decorative covers are typically provided with a decorative border which flattens in response to the weight of leaves or flowers of a plant disposed therein, and when a plant having substantial horizontal growth is disposed therein, the configuration formed in the decorative border is distorted or lost. In such a flattened condition, the decorative border cannot hold or support the leaves and flowers of a plant having substantial horizontal growth. In fact, the material from which the decorative border of the decorative cover is constructed may rip or tear in response to the weight of the leaves and flowers of the plant having substantial horizontal growth disposed therein.

Therefore, improved decorative covers for plants having substantial horizontal growth, as well as methods for packaging and containing such plants for show, sale or maintenance thereafter, are being sought. It is to such decorative covers and methods for packaging plants having substantial horizontal growth that the present invention is directed.

SUMMARY OF THE INVENTION

The present invention relates to a decorative cover having a decorative border which holds, cushions and supports the leaves, petioles and/or flowers of a plant having substantial horizontal growth to prevent damage thereto. Broadly, the decorative cover is provided with a base having a closed lower end, an open upper end and an object retaining space. The decorative cover also has a decorative border or skirt extending from the open upper end of the base so as to be disposed at an upward and outward angle with respect to the open upper end of the base, and the angle at which the decorative border or skirt extends from the base of the decorative cover is at least 40° relative to the horizontal axis of the base. The decorative border has a length which is at least substantially equal to the length of the leaves, petioles and flowers supported thereon when a plant is disposed in the object retaining space of the base of the decorative cover, and desirably, the length of the decorative border will be greater than the length of the leaves, petioles and flowers supported on the decorative border of the decorative cover.

The decorative border has a curvilinear, undulating, sinusoidal, or other similar configuration, which provides resiliency that permits the decorative border to yield to the weight of individual leaves, petioles and/or flowers, and to simultaneously hold and cushion the individual leaves, petioles and/or flowers of the plant supported on the decorative border. That is, the decorative border compresses underneath leaves, petioles and/or flowers supported thereon, thereby forming a partially compressed condition thereunder. When the decorative border is in a compressed condition, the angle of the decorative border relative to the base of the decorative cover decreases slightly such that the decorative border yields to the weight of the leaves, petioles and/or flowers of the plant while still maintaining the undulating configuration of the decorative border such that the decorative border holds, cushions and supports the leaves, petioles and/or flowers of the plant rather than flattening to a horizontal position which cannot provide any cushion or support.

The method of using the decorative cover includes the steps of providing the above-defined decorative cover, providing a plant having substantial horizontal growth contained in a pot, and disposing the pot containing the plant into the object retaining space of the decorative cover such that the base of the decorative cover substantially surrounds and encompasses the pot. The leaves and petioles of the plant are then positioned and arranged on the decorative border of the decorative cover whereby the decorative border yields to the weight of and resiliently cushions and holds the leaves and petioles of the plant. As stated above, the decorative border extends from the base of the decorative cover at an angle of at least 40° relative to the horizontal axis of the base of the decorative cover, and the yielding of the decorative border in response to the weight of the leaves and petioles of the plant may result in a decrease in the angle of the decorative border while maintaining the undulating configuration of the decorative border which holds, supports and cushions the leaves and petioles of the plant having substantial horizontal growth.

An object of the present invention is to provide a decorative cover for plants having substantial horizontal growth.

Another object of the present invention, while achieving the before-stated object, is to provide methods for using a decorative cover for plants having substantial horizontal growth with such a plant.

Other objects, features and advantages of the present invention will become apparent from the following detailed description when read in conjunction with the accompanying drawings and appended claims.

DETAILED DESCRIPTION OF THE INVENTION

The difficulty in presenting a plant having substantial horizontal growth, such as gesneriads and more specifically African violets, for sale, for show, or simply as an object of household enjoyment, is in presenting a plant in complete health. Many types of gesneriads, and specifically African violets, are known for their beauty, delicacy, and their substantial horizontal growth pattern. This substantial horizontal growth pattern, as opposed to a primarily vertical growth pattern seen in other types of flowering plants, places both the leaves and flowers of such plants at risk for damage to the underneath sides thereof. This damage or degradation is seen in off color or brown, sunken areas which occur at the points of contact against the flower pot cover. Further, a number of disease organisms can also enter the plant at the point of degradation, causing further damage to the plant. Primary pests to some gesneriads, including African violets, include cyclamen mites and broad mites, each of which is about 1/100-inch long and cannot be detected without magnification. In particular, broad mites attack older, bottom leaves and petioles, attacking both the upper and lower sides of the damaged surface. These attacks cause the leaves to turn yellowish, and the edges of the leaves may curl under.

Description of FIGS. 1–5

Figure 1:
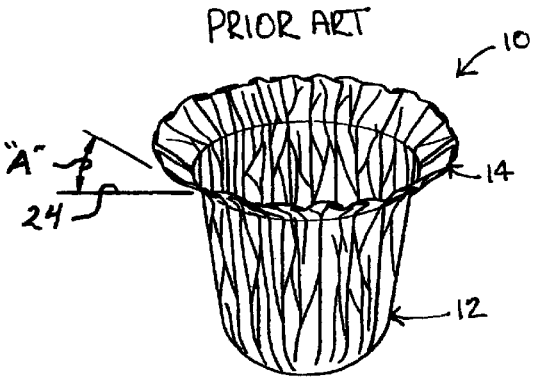
FIG. 1 is a perspective view of a decorative cover of the prior art.
Figure 1A:
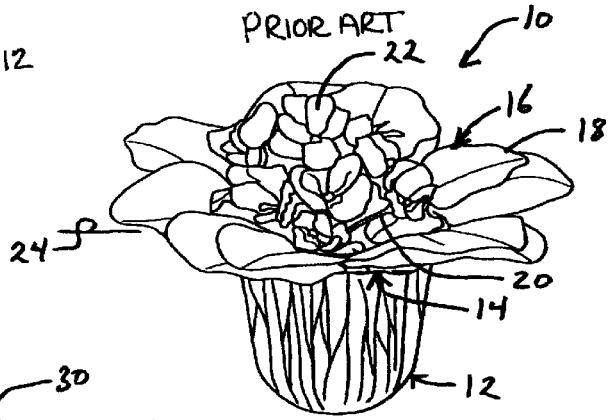
FIG. 1A is a perspective view of the decorative cover of FIG. 1, wherein a potted plant is disposed in the decorative cover.

Referring now to the drawings, and more particularly to FIG. 1, shown therein and designated herein by the reference numeral 10 is a decorative cover of the prior art, wherein the decorative cover 10 is provided with a base 12 and a decorative border 14. As shown in FIG. 1A, the decorative cover 10 has a potted plant 16 having leaves 18, petioles 20 and flowers 22, disposed therein. Typically, the decorative border 14 of the decorative cover 10 is provided with a preformed angle A which is generally about 30° relative to a horizontal axis 24 of the base 12 of the decorative cover 10, as shown in FIG. 1. When the potted plant 16 is disposed in the decorative cover 10, the decorative border 14 of the decorative cover 10 flattens out, and the angle A decreases until the decorative border 14 approaches a horizontal alignment, that is, the horizontal axis 24 of the base 12 of the decorative cover 10, as shown in FIG. 1A. In doing so, the material from which the decorative border 14 of the decorative cover 10 is constructed will be stretched, resulting in a loss of any configuration provided in the decorative border 14 and increasing the possibility of ripping or tearing occurring in the decorative border 14 and/or the base 12 of the decorative cover 10. Thus, the decorative border 14 of the decorative cover 10 is unable to hold, support or cushion the plant 16, if the plant 16 disposed therein has substantial horizontal growth, which results in damage to the plant 16.

In addition, as illustrated in FIG. 1A, the decorative border 14 of the decorative cover 10 is generally shorter in length than the length of the leaves 18, petioles 20 and/or flowers 22 of the potted plant 16 disposed in the decorative cover 10. The portion of the leaves 18, petioles 20 and/or flowers 22 of the potted plant 16 which extend beyond the decorative border 14 of the decorative cover 10 will not be supported by the decorative border 14 and will droop, resulting in possible damage or degradation thereto. The point of contact of the edge of the decorative border 14 of the decorative cover 10 on the leaves 18, petioles 20 and/or flowers 22 of the plant 16 which extend beyond the edge of the decorative border 14 will be particularly susceptible to damage and degradation thereto.

Figure 2:
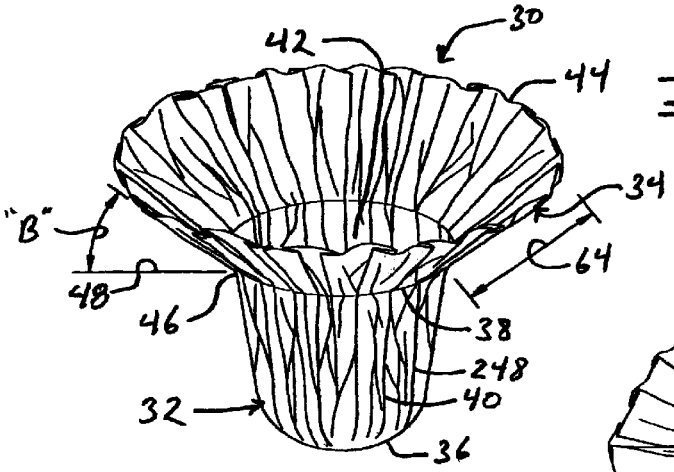
FIG. 2 is a perspective view of a decorative cover constructed in accordance with the present invention.

Shown in FIG. 2 and designated by the reference numeral 30 is a decorative flower pot cover constructed in accordance with the present invention. The decorative flower pot cover 30, sometimes herein referred to as a decorative cover, includes a base 32 and a decorative border or skirt 34. The base 32 of the decorative cover 30 has a closed lower end 36, an open upper end 38, an outer peripheral surface 40, and an object retaining space 42, extending from the open upper end 38 to the closed lower end 36 thereof. The decorative border 34 of the decorative cover 30 is provided with an upper end 44 and a lower end 46, and the lower end 46 of the decorative border 34 of the decorative cover 30 is connected to the open upper end 38 of the base 32 of the decorative cover 30. The decorative border 34 of the decorative cover 30 extends from the open upper end 38 of the base 32 of the decorative cover 30 so as to be disposed at an upward and outward angle with respect to the open upper end 38 of the base 32 of the decorative cover 30, wherein the angle is steeper than that of the decorative border 14 of the prior art decorative cover 10. The decorative border 34 of the decorative cover 30 is disposed at an angle B of at least about 40°, preferably in a range of from about 40° to about 55°, relative to the horizontal axis 48 of the base 32 of the decorative cover 30. The decorative cover 30 is formed from a sheet of material 50 (shown in FIG. 10 and described in detail hereinafter).

It will be appreciated that the characteristics of the decorative flower pot cover 30 may permit the decorative flower pot cover 30 to be flattened and then later unflattened, wherein the decorative flower pot cover 30 returns to its preformed, original shape without substantial loss of its preformed shape, illustrating a flexible yet resilient and shape-sustaining nature of the decorative flower pot cover 30, and thereby permitting ease of shipping and/or storage.

Figure 4:
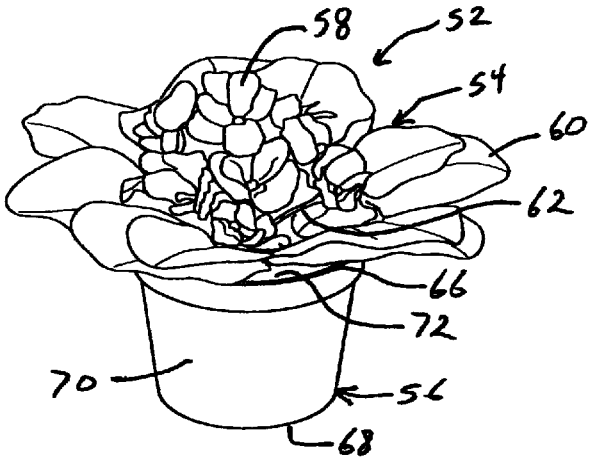
FIG. 4 is a perspective view of a pot having a plant with substantial horizontal growth disposed therein.

The decorative flower pot cover 30 is adapted to receive a plant 54, which is illustrated in FIG. 4 as being disposed in a flower pot 56. The plant 54 has substantial horizontal growth, such as an African violet, and includes one or more flowers 58, leaves 60 and/or petioles 62.

As shown in FIG. 2, the decorative border 34 of the decorative cover 30 has a length 64 sufficient to support the flowers 58, leaves 60 and petioles 62 of the plant 54 disposed therein, that is, the length 64 of the decorative border 34 of the decorative cover 30 is at least substantially equal to the length of the flowers 58, leaves 60 and petioles 62 supported thereon when the plant 54 is disposed in the object retaining space 42 of the base 32 of the decorative cover 30, and desirably, the length 64 of the decorative border 34 of the decorative cover 30 will be greater than the length of the flowers 58, leaves 60 and petioles 62 supported thereon.

When the plant 54 is disposed in the decorative flower pot cover 30, the decorative border 34 of the decorative cover 30 is configured to hold, cushion and support the flowers 58, leaves 60 and/or petioles 62 of the plant 54 without damage thereto, as described in detail herein after.

Figure 3:
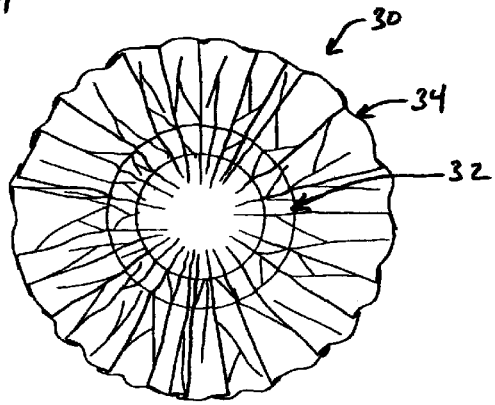
FIG. 3 is a top plan view of the decorative cover shown in FIG. 2.

As shown in FIGS. 2 and 3, the configuration of the decorative border 34 of the decorative flower pot cover 30 may be an undulating, curvilinear, sinusoidal configuration or fluted configuration having a succession of waves and curves. This configuration is created to allow for excess material to form a gentle, cushioning pattern to hold, support and cushion each individual leaf 60 and/or petiole 62 of the plant 54, and thus slightly decrease the angle at which the decorative border 34 is disposed relative to the horizontal axis 48 of the base 32 of the decorative cover 30. Such a configuration permits each portion of the decorative border 34 of the decorative cover 30 holding a leaf or leaves 60, and petiole or petioles 62, to individually relax and compress underneath each leaf/leaves 60 or petiole/petioles 62, thereby providing gentle, cushioning support for each individual leaf 60 and/or petiole 62. It will be appreciated that any other configuration known in the art may be utilized in providing the configuration of the decorative border 34 of the decorative cover 30, as long as the configuration can be maintained upon disposal of the plant 54 therein and so long as the decorative border 34 of the decorative cover 30 operates as shown and/or described herein.

It will be understood that the decorative flower pot cover 30, and particularly, the decorative border 34, has resilient properties. That is, the decorative border 34 of the decorative cover 30 is designed to support and cushion the individual weight of the leaves 60 and/or petioles 62 of the plant 54 and yield downward to such weight, thereby decreasing the angle at which the decorative border 34 is disposed relative to the horizontal axis 48 of the base 32 of the decorative cover 30 while still maintaining the undulating configuration of the decorative border 14. Yet, when the weight of the leaves 60 and/or petioles 62 of the plant 54 is removed, the decorative border 34 (or any portion thereof) of the decorative cover 30 will tend to "spring back" to the preformed angle B, thus demonstrating the resiliency of the decorative border 34 of the decorative cover 30.

Figure 5:
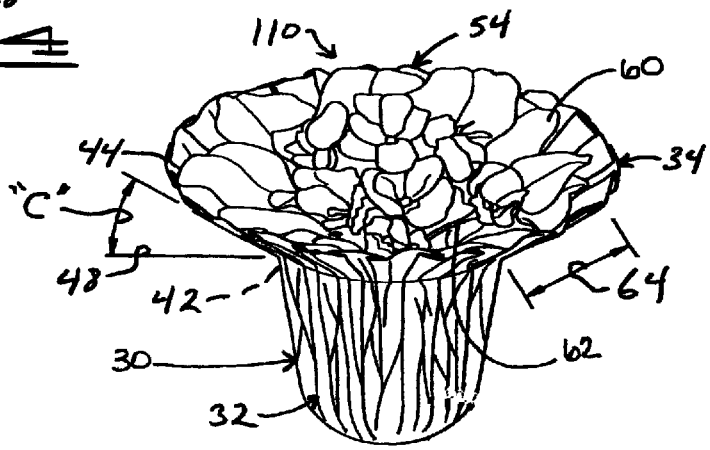
FIG. 5 is a perspective view of the decorative cover of FIG. 2 having the potted plant of FIG. 4 disposed therein, thereby forming a decorative assembly.

In a method of use of the decorative flower pot cover 30 as shown in FIGS. 2–5, the decorative flower pot cover 30 shown in FIGS. 2 and 3 and described herein is provided. As illustrated in FIG. 4, the plant 54 having substantial horizontal growth, such as an African violet, disposed in the flower pot 56, is provided. The flower pot 56 has an upper end 66, a lower end 68, an outer peripheral surface 70, and a plant receiving space 72. Pots and containers which can support a plant having substantial horizontal growth are known in the art and commercially available, so the characteristics and features of a pot or container that can be utilized as the flower pot 56 are well known. The plant 54 is disposed in the object retaining space 42 of the base 32 of the decorative flower pot cover 30, as shown in FIG. 5, or alternatively, the plant 54, with the appropriate growing medium, such as soil, dirt, and/or other materials (not shown), is disposed into the decorative flower pot cover 30. A decorative assembly 110 is formed when the plant 54, which may or may not be disposed in the flower pot 56, is disposed in the decorative flower pot cover 30. The base 32 of the decorative flower pot cover 30 is sized to substantially surround and encompass the outer peripheral surface 70 of the flower pot 56, or alternatively, when no flower pot 56 is utilized, the base 32 of the decorative flower pot cover 30 is sized to substantially surround and encompass any growing medium provided with the plant 54. The leaves 60 and petioles 62 of the plant 54 are then positioned and arranged on the decorative border 34 of the decorative flower pot cover 30. The length 64 of the decorative border 34 of the decorative cover 30 is at least substantially equal to the length of the flowers 58, leaves 60 and petioles 62 supported thereon, and desirably, the length 64 of the decorative border 34 of the decorative cover 30 is greater than the length of the flowers 58, leaves 60 and petioles 62 supported thereon. Therefore, the flowers 58, leaves 60 and petioles 62 do not extend beyond the upper end 44 of the decorative border 34 of the decorative cover 30.

As shown in FIG. 5, when the plant 54 is disposed in the object retaining space 42 of the base 32 of the decorative cover 30, the curvilinear, undulating configuration of the decorative border 34, which provides a cushion for the delicate leaves 60 and petioles 62 of the plant 54, permits the decorative border 34 to partially compress in response to the weight of individual leaves 60 and petioles 62 of the plant 54. During compression of the decorative border 34 of the decorative flower pot cover 30, the angle of the decorative border 34 relative to the horizontal axis 48 of the base 32 of the decorative cover 30 decreases so that the decorative border 34 moves toward a compressed condition, that is, the angle of the decorative border 34 decreases from angle B shown in FIG. 2 to angle C shown in FIG. 5, while still maintaining the undulating configuration of the decorative border 34 of the decorative cover 30. Desirably, the angle C is in a range of from about 25° to about 40° relative to the horizontal axis 48 of the base 32 of the decorative cover 30, and more desirably, the angle C is about 30° relative to the horizontal axis 48 of the base 32 of the decorative cover 30. The excess material provided by the undulating configuration of the decorative border 34 of the decorative cover 30 permits the decorative border 34 to resiliently and gently support individual leaves 60 and petioles 62 of the plant 54 when the plant 54 is disposed therein to prevent damage thereto and to accommodate the horizontal growth of said leaves 60 and petioles 62, while maintaining the integrity of the decorative border 34 of the decorative cover 30.

Figure 6:
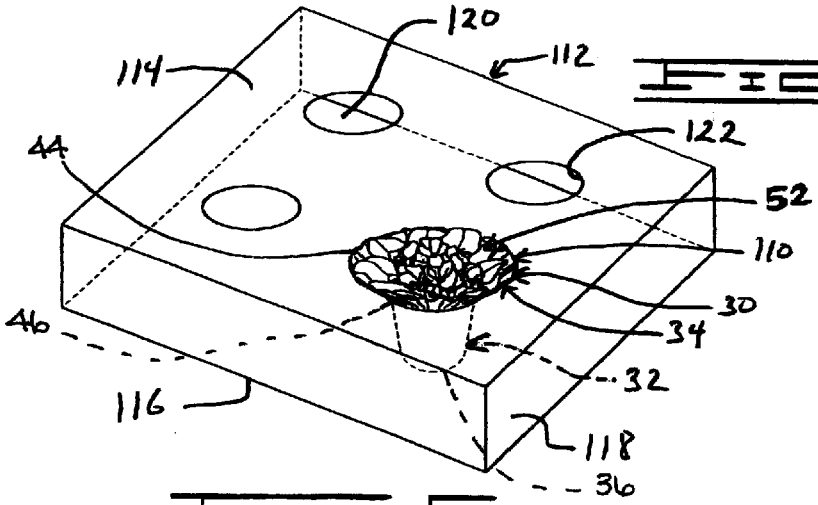
FIG. 6 is a perspective view of a transport and display container having the decorative assembly of FIG. 5 disposed therein.

Description of FIG. 6

Another advantage of the decorative border 34 of the decorative cover 30 will now be described with reference to the decorative assembly 110, which includes the decorative cover 30 and the plant 54 disposed therein. However, it should be understood that any of the decorative covers described hereinafter can be employed in place of the decorative cover 30 of the decorative assembly 110 without departing from the inventive concept set forth herein.

Referring now to FIG. 6, shown therein is a transport and display container 112 having an upper end 114, a lower end 116, a sidewall 118, an object retaining space 120 defined by the upper end 114, lower end 116, and sidewall 118 of the transport and display container 112, and one or more openings 122 in the upper end 114 of the transport and display container 112 which allow access to the object retaining space 120 of the transport and display container 112. The transport and display container 112 is sized and dimensioned to hold one or more decorative assemblies 110 in a stationary, stable position. Each opening 122 in the transport and display container 112 is adapted to receive the base 32 of one of the flower pot covers 30 so that the decorative assembly 110 formed of one of the flower pot covers 30 and the plant 54 disposed therein is stably supported in the transport and display container 112. The decorative assembly 110 is inserted through the opening 122 and into the object retaining space 120 of the transport and display container 112 such that the decorative assembly 110 is stabilized therein by engagement of the lower end 46 of the decorative border 34 of the decorative flower pot cover 30 of the decorative assembly 110 with the portion of the upper end 114 of the transport and display container 112 which is adjacent the opening 122 therein. Therefore, the upper end 44 of the decorative border 34 of the decorative cover 30 extends beyond the upper end 114 of the transport and display container 112 and is exposed.

It should be noted that the depth of the object retaining space 120 of the transport and display container 112 can be such that the closed lower end 36 of the base 32 of the decorative cover 30 of the decorative assembly 110 supportingly engages the lower end 116 of the transport and display container 112. This engagement may contribute to stably supporting the decorative assembly 110 in the transport and display container 112. Alternatively, the object retaining space 120 of the transport and display container 112 may be provided with a greater depth such that the lower end 36 of the base 32 of the decorative cover 30 of the decorative assembly 110 is suspended in the object retaining space 120 of the transport and display container 112 and is therefore not in contact with the lower end 116 of the transport and display container 112. In this instance, the engagement of the lower end 46 of the decorative border 34 of the decorative cover 30 of the decorative assembly 110 and the portion of the upper end 114 of the transport and display container 112 adjacent the opening 122 is responsible for stably maintaining the decorative assembly 110 in a fixed position in the transport and display container 112.

When it is desired to remove the decorative assembly 110 from the transport and display container 112, an individual grasps the decorative assembly 110 by the exposed decorative border 34 of the decorative cover 30 and lifts the decorative assembly 110 from the transport and display container 112. The resilient characteristics of the decorative border 34 of the decorative cover 30 allow for flexibility in movement for removal of the decorative assembly 110 from the transport and display container 112 while supporting the plant 54 disposed in the object retaining space 42 of the base 32 of the decorative cover 30.

Figure 7:
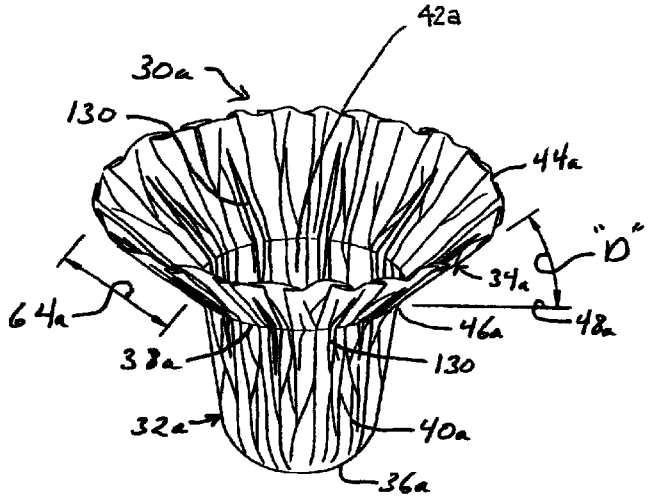
FIG. 7 is a perspective view of another embodiment of a decorative cover constructed in accordance with the present invention.
Figure 8:
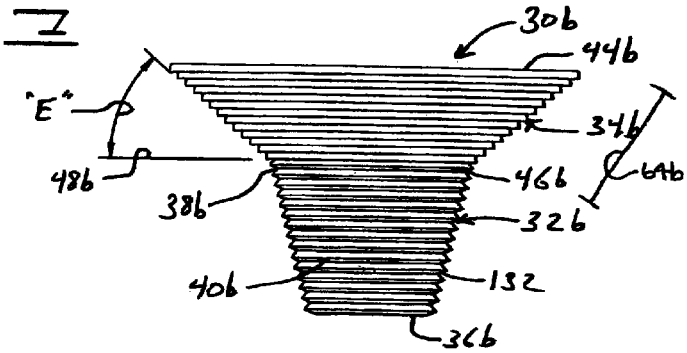
FIG. 8 is a side elevational view of yet another embodiment of a decorative cover constructed in accordance with the present invention.
Figure 9:
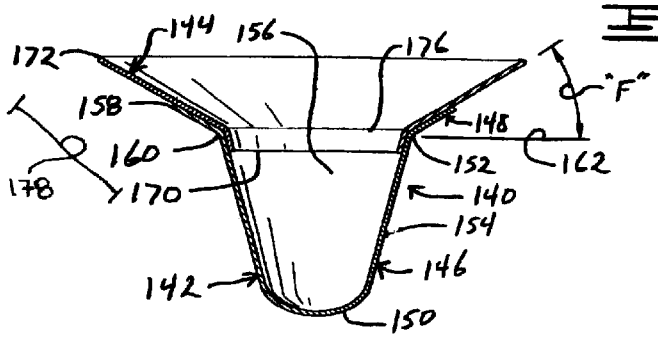
FIG. 9 is a cross-sectional view of another embodiment of a decorative cover constructed in accordance with the present invention, wherein the decorative cover is provided with a collar.

Description of FIGS. 7–9

For the decorative covers of the present invention to support the growth of a plant having substantial horizontal growth without causing damage to the delicate leaves and petioles thereof, a decorative border of the decorative cover must not only be provided with a length which is at least substantially equal to the length of the leaves, petioles and flowers supported thereon which extend from the plant having substantial horizontal growth disposed in the decorative cover, but the decorative border of the decorative cover must also be provided with excess material which can form a gentle, cushioning pattern which holds, supports and cushions each individual leaf, flower and petiole of the plant to prevent damage thereto and to accommodate horizontal growth of the plant while maintaining the integrity of the decorative border of the decorative cover. While one embodiment of such a decorative cover has been described above with reference to FIGS. 2, 3, 5 and 6, shown in FIGS. 7–9 are three other versions of decorative covers, each of which is provided with a decorative border that can support and cushion the leaves, flowers and petioles of a plant having substantial horizontal growth when the plant is disposed therein.

Shown in FIG. 7 is another embodiment of a flower pot cover or decorative cover designated by the reference numeral 30*a*. The decorative flower pot cover 30*a* is similar to the decorative flower pot cover 30 shown in FIGS. 2, 3, 5 and 6 and described hereinbefore, except as described below.

The decorative flower pot cover 30*a* includes a base 32*a* and a decorative border or skirt 34*a*. The base 32*a* of the decorative flower pot cover 30*a* has a closed lower end 36*a*, an open upper end 38*a*, an outer peripheral surface 40*a* and an object retaining space 42*a*. The decorative border 34*a* of the decorative cover 30*a* is provided with an upper end 44*a* and a lower end 46*a*, wherein the lower end 46*a* is connected to the open upper end 38*a* of the base 32*a* of the decorative cover 30*a*. The decorative border 34*a* of the decorative cover 30*a* extends from the open upper end 38*a* of the base 32*a* of the decorative cover 30*a* so as to be disposed at an upward and outward angle D of at least about 40°, and preferably in a range of from about 40° to about 55°, relative to a horizontal axis 48*a* of the base 32*a* of the decorative cover 30*a*.

The decorative border 34*a* of the decorative cover 30*a* is provided with a length 64*a* which is at least substantially equal to the length of the flowers, leaves and petioles of a plant having substantial horizontal growth supported thereon when a plant, such as the plant 54 disposed in the flower pot 56, is disposed in the object retaining space 42*a* of the base 32*a* of the decorative cover 30*a*, and desirably, the length 64*a* of the decorative border 34*a* of the decorative cover 30*a* is greater than the length of the flowers, leaves and petioles supported thereon. The decorative border 34*a* of the decorative cover 30*a* is configured to permit support of the flowers, leaves and petioles of the plant without damage thereto.

As shown in FIG. 7, at least a portion of the base 32*a* and at least a portion of the decorative border 34*a* of the decorative cover 30*a* are provided with void areas 130 such as cuts or slots therein which allow for expansion of the decorative border 34*a*, thereby allowing the decorative border 34*a* to form a gentle, cushioning pattern to hold, support and cushion each individual leaf and/or petiole of a delicate plant having substantial horizontal growth and disposed in the decorative cover 30*a*. Such a configuration permits each portion of the decorative border 34*a* of the decorative cover 30*a* holding a leaf or leaves, and petiole or petioles, to individually relax and compress somewhat underneath each leaf/leaves and petiole/petioles, thereby providing gentle, cushioning support for each individual leaf and/or petiole while still maintaining the integrity of the decorative border 34*a*. The portion of the void areas 130 positioned in the base 32*a* of the decorative cover 30*a* are substantially vertical. The portion of the void areas 130 positioned in the decorative border 34*a* of the decorative cover 30*a* are typically vertical and radiate outwardly from the portion of the void areas 130 positioned in the base 32*a* of the decorative cover 30*a,* but the positioning of such portion of the void areas 130 will match the alignment of the decorative border 34*a* of the decorative cover 30*a*.

Upon disposal of a plant, such as the plant 54, in the object retaining space 42*a* of the base 32*a* of the decorative cover 30*a,* the void areas 130 expand and allow the angle D at which the decorative border 34*a* of the decorative cover 30*a* is disposed relative to the horizontal axis 48*a* of the base 32*a* of the decorative cover 30*a* to decrease, thereby allowing the decorative border 34*a* to move toward a compressed condition while maintaining the integrity of the decorative border 34*a*. That is, the angle of the decorative border 34*a* of the decorative cover 30*a* decreases from angle D shown in FIG. 7 to an angle (not shown) similar to angle C of the decorative cover 30 having the plant 54 disposed therein of FIG. 5 and which is preferably in a range of from about 25° to about 40°, and more preferably about 30°, relative to the horizontal axis 48*a* of the base 32*a* of the decorative cover 30*a* when a plant is disposed therein. Such an angle permits the decorative border 34*a* of the decorative cover 30*a* to resiliently and gently support individual leaves and petioles of a plant having substantial horizontal growth when the plant is disposed in the object retaining space 42*a* of the base 32*a* of the decorative cover 30*a* to prevent damage thereto and to accommodate the horizontal growth of said plant.

Shown in FIG. 8 is another embodiment of a flower pot cover or decorative cover designated by the reference numeral 30*b*. The decorative flower pot cover 30*b* is similar to the decorative flower pot cover 30 shown in FIGS. 2, 3, 5 and 6 and described hereinbefore, except as described below.

The decorative flower pot cover 30*b* includes a base 32*b* and a decorative border or skirt 34*b*. The base 32*b* of the decorative cover 30*b* has a closed lower end 36*b,* an open upper end 38*b,* an outer peripheral surface 40*b* and an object retaining space (not shown). The decorative border 34*b* of the decorative cover 30*b* is provided with an upper end 44*b* and a lower end 46*b,* wherein the lower end 46*b* is connected to the open upper end 38*b* of the base 32*b* of the decorative cover 30*b*. The decorative border 34*b* of the decorative cover 30*b* extends from the open upper end 38*b* of the base 32*b* of the decorative cover 30*b* so as to be disposed at an upward and outward angle E of at least about 40°, preferably in a range of from about 40° to about 55°, relative to a horizontal axis 48*b* of the base 32*b* of the decorative cover 30*b*.

The decorative border 34*b* of the decorative cover 30*b* is provided with a length 64*b* which is at least equal to the length of flowers, leaves and petioles of a plant having substantial horizontal growth supported thereon when the plant, such as the plant 54, is disposed in the object retaining space of the base 32*b* of the decorative cover 30*b,* and desirably, the length 64*b* of the decorative border 34*b* of the decorative cover 30*b* will be greater than the length of the flowers, leaves and petioles supported thereon. The decorative border 34*b* of the decorative cover 30*b* is configured to permit support of the flowers, leaves and petioles of the plant without damage thereto.

Upon forming the base 32*b* of the decorative cover 30*b,* at least a portion of the base 32*b* is provided with billows or corrugations 132 formed therein in a substantially horizontal direction. The billows or corrugations 132 will allow the height of the decorative cover 30*b* to be adjusted, thereby expanding such height by extending the billows or corrugations 132 and exposing the excess material contained therein. The billows or corrugations 132 may also be formed in at least a portion of the decorative border 34*b* of the decorative cover 30*b,* such as in FIG. 8, where the corrugations 132 are formed in both the base 32*b* and the decorative border 34*b* of the decorative cover 30*b*. However, it will be understood that the corrugations 132 may be present in only a portion of the base 32*b* of the decorative cover 30*b* alone, or in a portion of the base 32*b* and a portion of the decorative border 34*b* of the decorative cover 30*b,* or in substantially all of the base 32*b* and the decorative border 34*b* of the decorative cover 30*b*.

When the base 32*b* of the decorative cover 30*b* is provided with billows or corrugations 132 formed therein, the billows or corrugations 132 will allow the decorative cover 30*b* to expand in a vertical direction to increase the height of the decorative cover 30*b,* and, to a lesser extent, the billows or corrugations 132 formed in the base 32*b* of the decorative cover 30*b* also allow the decorative cover 30*b* to expand in a horizontal direction to increase the diameter of the object retaining space 42*b* of the base 32*b* of the decorative cover 30*b*. Therefore, the decorative cover 30*b* can accommodate flower pots which vary in size. That is, the billows or corrugations 132 will allow the decorative cover 30*b* to hold a flower pot having an increased height and/or, to a lesser extent, an increased width. The billows or corrugations 132 will also allow for adjustment of the length 64*b* of the decorative border 34*b* of the decorative cover 30*b* to accommodate growth of a plant disposed therein in a horizontal direction.

Upon disposal of a plant, such as the plant 54, in the object retaining space of the base 32*b* of the decorative cover 30*b,* the billows or corrugations 132 provide excess material which extends the decorative border 34*b* of the decorative cover 30*b,* and the angle at which the decorative border 34*b* is disposed relative to the horizontal axis 48*b* of the base 32*b* of the decorative cover 30*b* decreases such that the decorative border 34*b* moves toward a compressed condition while maintaining the integrity of the decorative border 34*b*. That is, the angle of the decorative border 34*b* of the decorative cover 30*b* decreases from angle E shown in FIG. 8 to an angle (not shown) similar to angle C of the decorative cover 30 having the plant 54 disposed therein of FIG. 5 and which is preferably in a range of from about 25° to about 40°, and more preferably about 30°, relative to the horizontal axis 48*b* of the base 32*b* of the decorative cover 30*b*. Such an angle permits the decorative border 34*b* of the decorative cover 30*b* to resiliently and gently support individual leaves and petioles of a plant having substantial horizontal growth when the plant is disposed in the object retaining space of the base 32*b* of the decorative cover 30*b*.

Shown in FIG. 9 is a cross-sectional view of another embodiment of a decorative cover designated by the reference numeral 140. The decorative cover 140 includes a flower pot cover 142 and a collar 144. The flower pot cover 142 includes a base 146 and a decorative border or skirt 148. The base 146 has a closed lower end 150, an open upper end 152, an outer peripheral surface 154 and an object retaining space 156. The decorative border 148 is provided with an upper end 158 and a lower end 160, wherein the lower end 160 of the decorative border 148 is connected to the open upper end 152 of the base 146 of the flower pot cover 140. The decorative border 148 extends from the open upper end 152 of the base 146 so as to be disposed at an upward and outward angle F of at least about 40°, preferably in a range of from about 40° to about 55°, relative to a horizontal axis 162 of the base 146 of the decorative cover 140.

Figure 10:
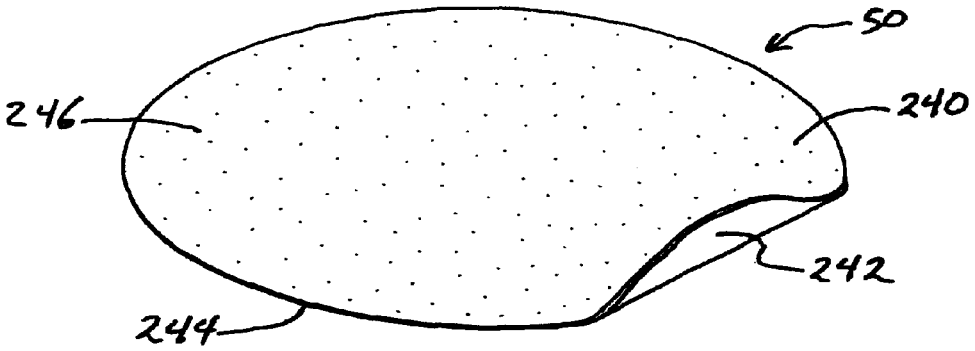
FIG. 10 is a perspective view of a sheet of material from which the decorative cover of FIG. 2 is constructed, one edge thereof being turned upwardly to show a lower surface of the sheet of material.

The collar 144 is constructed of a sheet of material which is substantially flexible. The sheet of material may be formed of the same materials as the sheet of material from which the flower pot cover 142 is formed, which is substantially similar to the sheet of material 50 from which the decorative flower pot cover 30 is formed (as shown in FIG. 10 and described in detail hereinbelow), or the sheet of material from which the collar 144 is constructed may be formed of a different material than the material from which the flower pot cover 142 is formed.

The collar 144 is provided with a lower end 170, an upper end 172 and an opening 176 formed through a portion thereof. The opening 176 of the collar 144 is generally circularly shaped, but may assume any shape which corresponds to the shape of the flower pot cover 142. The collar 144 is inserted into an upper portion of the base 146 of the flower pot cover 142 such that a lower portion of the collar 144 is substantially adjacent the decorative border 148 of the flower pot cover 142. The lower end 170 of the collar 144 may be generally disposed adjacent the upper end 152 of the base 146 of the flower pot cover 142 and the lower end 160 of the decorative border 148 of the flower pot cover 142. The collar 144 extends upwardly and outwardly from the flower pot cover 142 at an angle substantially similar to the angle F at which the decorative border 148 extends from the base 146 of the flower pot cover 142. That is, the collar 144 is disposed at an angle of at least about 40°, and preferably in a range of about 40° to about 55°, relative to the horizontal axis 162 of the base 146 of the flower pot cover 142.

The collar 144 may be bondingly connected to the flower pot cover 142 or to a flower pot disposed within the flower pot cover 142 by any of the methods known in the art. Alternatively, the collar 144 may not be attached to the flower pot cover 142. Methods for providing a decorative cover for a flower pot including a collar are described in U.S. Pat. No. 5,077,937 entitled "Apparatus For Providing A Decorative Cover For A Flower Pot Using A Collar" issued to Weder et al on Jan. 7, 1992; U.S. Pat. No. 4,835,834 entitled "Method Of Shaping And Holding A Sheet Of Material About A Flower Pot With A Collar", issued to Weder on Jun. 6, 1989; U.S. Pat. No. 5,987,849 entitled "Method For Providing A Multi-Layered Decorative Cover For A Flower Pot", issued to Weder on Nov. 23, 1999; and U.S. Pat. No. 6,009,665 entitled "Method For Providing A Decorative Cover For A Flower Pot", issued to Weder on Jan. 4, 2000, the Specifications of which are all hereby expressly incorporated herein by reference. Therefore, no further discussion of the use of the collar 144 with the flower pot cover 142 to form the decorative cover 140 is required herein.

The portion of the collar 144 of the decorative cover 140 which extends beyond the base 146 of the flower pot cover 142 is provided with a length 178 which is at least equal to the length of the flowers, leaves and petioles of a plant having substantial horizontal growth supported thereon when the plant is disposed within the object retaining space 156 of the base 146 of the flower pot cover 142, and desirably, the length 178 of the collar 144 will be greater than the length of the flowers, leaves and petioles supported thereon.

The collar 144 is configured to hold, support and cushion each individual leaf and/or petiole of the delicate plant having substantial horizontal growth. Such a configuration permits each portion of the collar 144 holding a leaf or leaves, and petiole or petioles, to individually relax and compress somewhat underneath each leaf/leaves and petiole/petioles, thereby providing gentle, cushioning support for each individual leaf and/or petiole. That is, the angles at which the collar 144, and therefore the decorative border 148 of the flower pot cover 142, are disposed relative to the horizontal axis 162 of the base 146 of the flower pot cover 142 decrease in response to the weight of the flowers, leaves and petioles of a plant having substantial horizontal growth supported thereon such that the collar 144 and the decorative border 148 of the flower pot cover 142 move toward a compressed condition while maintaining the integrity of the collar 144 and the decorative border 148 of the flower pot cover 142. That is, the angle F shown in FIG. 9 decreases to an angle similar to angle C of the decorative cover 30 having the plant 54 disposed therein of FIG. 5 wherein the angle is in a range of from about 25° to about 40°, and preferably about 30°, relative to the horizontal axis 162 of the base 146 of the flower pot cover 142. However, it will be understood that the angle may approach the horizontal axis 162 of the base 146 of the flower pot cover 142 if the integrity of the collar 144 and the decorative border 148 of the flower pot cover 142 is maintained. Such an angle permits the collar 144 to resiliently and gently support individual leaves and petioles of a plant, such as the plant 54, when the plant is disposed in the object retaining space 156 of the base 146 of the flower pot cover 142.

The upper end 158 of the decorative border 148 of the flower pot cover 142 and the upper end 172 of the collar 144 may be positioned substantially adjacent each other such that the decorative border 148 of the flower pot cover 142 and the collar 144 extend from the flower pot cover 142 for substantially the same length, or the upper end 172 of the collar 144 may extend beyond the upper end 158 of the decorative border 148 of the flower pot cover 142. When the decorative border 148 of the flower pot cover 142 extends to substantially the same length as the collar 144, the decorative border may contribute to the functions of supporting and cushioning the flowers, leaves and petioles of a plant having substantial horizontal growth disposed in the decorative cover 140.

While FIG. 9 illustrates a decorative cover 140 including the flower pot cover 142 and the collar 144, it will be understood that the present invention is not limited to the use of the flower pot cover 142 and collar 144, and a decorative cover may be formed simply by placing the collar 144 about a flower pot, such as the flower pot 56 as shown in FIG. 4, or by placing the collar 144 about a plant, such as the plant 54 shown in FIG. 4. The collar 144 may be bondingly connected to the flower pot as described herein above, or the collar 144 may not be attached to the flower pot. When utilized with a flower pot having a plant disposed therein, the collar 144 will possess all of the characteristics of the collar 144 of the decorative cover 140 and function in the same manner to hold, support and cushion each individual leaf and/or petiole of the plant.

For example, the present invention also envisions a decorative assembly formed of a plant having substantial horizontal growth and a collar for supporting leaves and petioles of a plant having substantial horizontal growth so as to prevent damage thereto. The plant is disposed in a flower pot having an upper end. The collar has a lower end, an upper end, an opening through a portion thereof and a length extending between the upper and lower ends thereof. The lower end of the collar is disposed substantially adjacent the upper end of the flower pot, and the collar extends upwardly and outwardly at an angle with respect to the upper end of the flower pot. The length of the collar is at least equal to the length of the leaves and petioles of the plant such that when the leaves and petioles of the plant are positioned on the collar, the angle of the collar relative to a horizontal axis of the flower pot decreases so that the collar moves toward a compressed condition, thereby permitting the collar to resiliently hold and gently support the individual leaves and petioles of the plant to prevent damage thereto and to accommodate horizontal growth of the leaves and petioles of the plant.

In yet another example, the present invention also envisions a method of using a collar with a plant having substantial horizontal growth. In such method, a collar is provided for supporting leaves and petioles of a plant having substantial horizontal growth so as to prevent damage thereto. The collar has a lower end, an upper end, an opening through a portion thereof and a length extending between the upper and lower ends thereof. The collar is disposed about a flower pot such that a lower portion of the collar is disposed near an upper end of the flower pot and the collar extends upwardly and outwardly at an angle with respect to the upper end of the flower pot. The length of the collar is at least equal to the length of the leaves and petioles of the plant. Upon positioning and arranging the leaves and petioles of the plant on the collar, the angle of the collar relative to a horizontal axis of the flower pot decreases so that the collar moves toward a compressed condition, thereby permitting the collar to resiliently hold and gently support the individual leaves and petioles of the plant to prevent damage thereto and to accommodate horizontal growth of the leaves and petioles of the plant.

Figure 11:
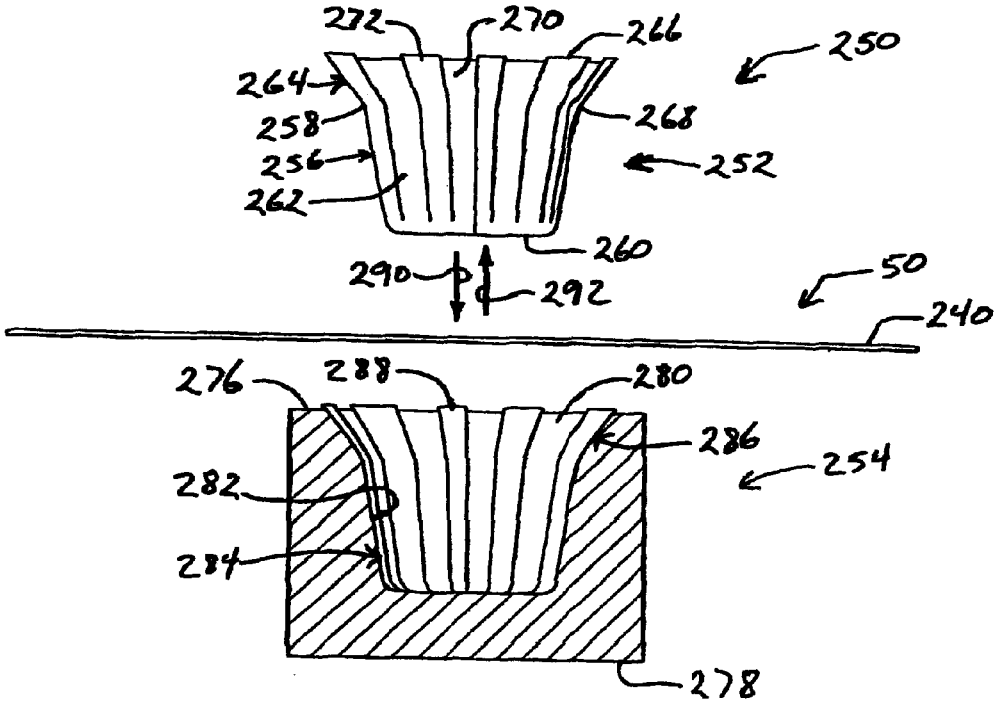
FIG. 11 is a diagrammatic, cross-sectional view of an article forming system for forming the sheet of the material of FIG. 10 into the decorative cover of FIG. 2.

Description of FIGS. 10 and 11

Turning now to FIG. 10, shown therein is the sheet of material 50 utilized to form the decorative cover 30 shown in FIG. 2 and described in detail hereinbefore. However, it will be understood that the decorative covers 30*a,* 30*b* and 140 described herein with reference to FIGS. 7–9 may be constructed of a sheet of material substantially similar to the sheet of material 50, and the decorative covers 30*a,* 30*b* and 140 may be constructed in a substantially similar manner as that described hereinbelow for the decorative cover 30.

The sheet of material 50 has an upper surface 240, a lower surface 242, and an outer periphery 244. The thickness of the sheet of material 50 from which the decorative cover 30 is constructed can vary widely, as long as the sheet of material 50 can be formed into the decorative cover 30 having the characteristics and functions as described herein. Generally, however, the sheet of material 50 from which the decorative cover 30 is constructed will have a thickness of from about 0.1 mil to about 30 mil. The sheet of material 50 can be constructed of a material which is flexible, yielding and non-shape sustaining.

The sheet of material 50 may be of any shape or combination of shapes, and a circular shape is shown in FIG. 10 only by way of example. The sheet of material 50 may be any geometric, non-geometric and/or asymmetric shape, as long as the sheet of material 50 functions as shown and described in detail herein.

The sheet of material 50 is constructed from any suitable material that is capable of being formed into the decorative cover 30 as described herein. The sheet of material 50 may be fabricated of paper, polymeric film, foil, metallized film, fabric, fiber, cloth, burlap, and combinations and laminations thereof.

The term "polymeric film" as used herein includes a thermoplastic resinous material such as, but not by way of limitation, a synthetic polymer such as a polypropylene or polyethylene. The term "polymeric film" as used herein also includes a naturally occurring polymer such as cellophane. A polymeric film, as contemplated and described in detail herein, is relatively strong and not as subject to tearing (substantially non-tearable), as might be the case with paper or foil. The term "polymeric film" as used herein also includes extruded, coextruded and expanded core polymeric materials.

The sheet of material 50 may be constructed of a single layer of material or a plurality of layers of the same or different types of materials. One or more layers of material may be laminated or bonded together, completely or partially, by any of the methods known in the art, to form the sheet of material 50. When multiple layers of material are used to form the sheet of material 50, the layers of material need not be uniform in size or shape. That is, one layer of material may extend beyond at least a portion of the outer periphery of another layer of material to form the sheet of material 50 as long as the cushioning effect of the decorative border 34 of the decorative cover 30 made from such material is maintained. For example, the sheet of material 50 may be a laminated material comprising a smaller layer of material and a larger layer of material. The base 32 of the decorative cover 30 may be formed of the laminated material, while the decorative border 34 of the decorative cover 30 may only comprise a single layer of material formed from the larger layer of material.

The sheet of material 50 may be formed of a material which has elasticity or may be treated in such a manner as to provide the sheet of material 50 with elastic characteristics. For example, ethylene vinyl acetate may be added to a polymeric film to form a sheet of material 50 which has elastic properties. Alternatively, the sheet of material 50 may be heated to make the sheet of material 50 more flexible and more pliable.

Preferably, the sheet of material 50 is a laminated material, such as a laminate formed of polymeric film laminated to paper, metallized film or another polymeric film, or a coextruded material, such as a polymeric film coextruded with ethylene vinyl acetate.

The sheet of material 50 may be provided with characteristics such as designs or decorative patterns which are printed, etched and/or embossed thereon using inks or other printing, etching or embossing materials. An example of an ink which may be applied to either surface of the sheet of material 50 is described in U.S. Pat. No. 5,147,706, entitled "Water Based Ink On Foil And/Or Synthetic Organic Polymer", issued to Kingman on Sep. 15, 1992, and which is hereby expressly incorporated herein by reference.

In addition, the sheet of material 50 may also be provided with characteristics such as various colorings, coatings, embossings, flockings and/or metallic finishes, or other decorative surface ornamentation applied separately or simultaneously. The sheet of material 50 may be characterized totally or partially by pearlescent, translucent, transparent, iridescent, neon, holographic, opaque, clear or the like, designs or finishes. Each of the above-named characteristics may occur alone or in combination with other characteristics described herein, and may be applied to at least a portion of at least one of the upper surface 240 and the lower surface 242 of the sheet of material 50. Moreover, the upper surface 240 and the lower surface 242 of the sheet of material 50 may vary in the combination of such characteristics. The sheet of material 50 may also be partially or completely opaque, translucent, clear and/or tinted transparent.

A bonding material 246, such as a heat sealable lacquer, may be disposed on at least a portion of the sheet of material 50. The bonding material 246 is shown disposed on at least a portion of the upper surface 240 of the sheet of material 50 in FIG. 10 for purposes of example only, and it will be understood that the bonding material 246 may be disposed on at least a portion of the lower surface 242 of the sheet of material 50 or on at least a portion of both the upper and lower surfaces 240 and 242 of the sheet of material 50. The bonding material 246 may be disposed in a strip, in the form of spaced apart spots, or in any geometric, non-geometric and/or asymmetric shape, or any combination thereof, including any pattern or plurality of patterns. The bonding material 246 may be disposed on only the portion of the sheet of material 50 which will form the base 32 of the decorative cover 30, or the bonding material 246 may be disposed on the portions of the sheet of material 50 which will form the base 32 and at least a portion of the decorative border 34 of the decorative cover 30. When the bonding material 246 is only disposed on the portion of the sheet of material 50 which will form the base 32 of the decorative cover 30, the excess material provided in the decorative border 34 of the decorative cover 30 can expand easily and provide more surface area to support the flowers 58, leaves 60 and petioles 62 of the plant 54 disposed in the decorative cover 30. Alternatively, when the bonding material 246 is disposed on a portion of the sheet of material 50 which will form the decorative border 34 of the decorative cover 30, the decorative border 34 will maintain the configuration formed therein, such as the sinusoidal, undulating scalloped configuration shown in FIG. 3.

In the present embodiment, an article forming system 250, shown in FIG. 11, is utilized to form the sheet of material 50 into the decorative flower pot cover 30. It will be understood, however, that any system may be utilized to form the sheet of material 50 into the decorative flower pot cover 30 shown and described in detail herein, so long as the decorative flower pot cover 30 is formed to function as described in detail and illustrated herein. An article forming system which would function to form the sheet of material 50 into the decorative flower pot cover 30, with some modification as described below, is found in U.S. Pat. No. 4,773,182, entitled "Article Forming System", issued to Weder et al on Sep. 27, 1988, which is hereby expressly incorporated herein by reference. The base 32 of the decorative flower pot cover 30 may be formed by substantially fixing a portion of the sheet of material 50 into a plurality of overlapping folds 248 (FIG. 2) to form the base 32 of the decorative flower pot cover 30, wherein the fixed overlapping folds 248 cooperate to retain the decorative flower pot cover 30 in a formed shape. These characteristics, as well as other characteristics of flower pot covers, are discussed in detail in the above-incorporated by reference patents, and it will be appreciated that these characteristics may be utilized in the present invention, and are, likewise, incorporated by reference as well.

Referring now to FIG. 11, shown therein is the article forming system 250 utilized to form the sheet of material 50 into the decorative flower pot cover 30. The article forming system 250 includes a male die 252 and a female die 254. The male die 252 has a base portion 256 having an upper end 258, a lower end 260, and an outer surface 262. The male die 252 also includes a flared portion 264, which is provided with an upper end 266, a lower end 268 and an outer surface 270. The lower end 268 of the flared portion 264 is connected to the upper end 258 of the base portion 256 of the male die 252. The outer surface 270 of the flared portion 264 has a specific pattern 272, which produces the undulating, curvilinear, sinusoidal configuration of the decorative border 34 of the decorative flower pot cover 30 which has a succession of waves and curves. It will be appreciated that the flared portion 264 of the male die 252 extends at an angle outwardly and upwardly from the upper end 258 of the base portion 256 of the male die 252. The dimensions of the base portion 256 are slightly larger than the comparable dimensions of the outer peripheral surface 70 of the flower pot 56 (FIG. 4) in which the plant 54 having substantial horizontal growth is disposed, such that the decorative flower pot cover 30 formed from the sheet of material 50 utilizing the article forming system 250 will fit generally about the outer peripheral surface 70 of the flower pot 56.

The female die 254 of the article forming system 250 has an upper end 276 and a lower end 278. The male die 252 is supported a distance generally above and generally aligned with the female die 254. An opening 280 is formed through the upper end 276 of the female die 254 and extends a distance generally toward the lower end 278 of the female die 254. The opening 280 forms an inner surface 282 of the female die 254. The opening 280 forming the inner surface 282 is shaped and sized to receive and formingly mate with the outer surfaces 262 and 270 of the base portion 256 and flared portion 264, respectively, of the male die 252 with a sufficient clearance therebetween to accommodate portions of the sheet of material 50 during the forming of the decorative cover 30.

The female die 254 includes a base portion 284 which is substantially frusto-conically shaped. The base portion 284 of the female die 254 is shaped to mate with the base portion 256 of the male die 252 with sufficient clearance therebetween to accommodate portions of the sheet of material 50 during the forming of the decorative cover 30.

The female die 254 also includes a flared portion 286. The flared portion 286 of the female die 254 extends at an angle outwardly and upwardly from the base portion 284 of the female die 254. The flared portion 286 of the female die 254 is shaped to mate with the flared portion 264 of the male die 252 with sufficient clearance therebetween to accommodate portions of the sheet of material 50 during the forming of the decorative cover 30. The inner surface 282 of the flared portion 286 of the female die 254 is provided with a specific pattern 288 which is complementary to the specific pattern 272 of the outer surface 270 of the flared portion 264 of the male die 252. It will be appreciated that the inner surface 282 of the flared portion 286 of the female die 254, and thus the specific pattern 288 formed therein, mates in alignment with the outer surface 270 of the flared portion 264 of the male die 252, and thus the specific pattern 272 formed therein, to form the undulating, curvilinear, sinusoidal configuration of the decorative border 34 of the decorative flower pot cover 30.

In operation, the male die 252 is in a retracted or storage position wherein the male die 252 is disposed a distance above and aligned with the female die 254 substantially as shown in FIG. 11. The sheet of material 50 is then disposed generally over the opening 280 in the female die 254. After the sheet of material 50 has been positioned over the opening 280 in the female die 254, the male die 252 is moved in a downward direction as indicated by the arrow 290 toward the female die 254. As the male die 252 moves in the downward direction 290, the male die 252 moves to a position wherein the lower end 260 of the base portion 256 of the male die 252 initially engages the upper surface 240 of the portion of the sheet of material 50 disposed over the opening 280 in the female die 254. Continued movement of the male die 252 in the downward direction 290 pushes portions of the sheet of material 50 generally into the opening 280 in the upper end 276 of the female die 254 until the male die 252 is matingly disposed within the female die 254. Heat, pressure, or any other method of forming the non-shape sustaining sheet of material 50 into the substantially shape-sustaining decorative cover 30 and maintaining the non-shape sustaining sheet of material 50 as the substantially shape-sustaining decorative cover 30 is then applied via the article forming system 250. The base portion 284 of the female die 254 cooperates with the base portion 256 of the male die 252 to form the portion of the sheet of material 50 disposed therebetween into the base 32 of the decorative cover 30, and the flared portion 286 of the female die 254 cooperates with the flared portion 264 of the male die 252 to form the portion of the sheet of material 50 disposed therebetween into the decorative border 34 of the decorative cover 30. Once the sheet of material 50 has been formed into the decorative cover 30, the male die 252 is moved in an upward direction as indicated by the arrow 292 to the storage position as illustrated in FIG. 11, and the decorative cover 30 is removed from the article forming system 250.

The surface area of the portions of the sheet of material 50 which is pushed into the base portion 284 of the female die 274 and which is utilized to form the base 32 of the decorative cover 30 exceeds the surface area of either the base portion 256 of the male die 252 or the base portion 284 of the female die 254 and also the outer peripheral surface 40, including the closed lower end 36 of the base 32, of the decorative cover 30. This excess material utilized to form the base 32 of the decorative cover 30 is utilized to form the overlapping folds 248 in the decorative cover 30.

While only one method of forming the decorative covers constructed in accordance with the present invention has been shown and described herein, it will be understood that the decorative covers of the present invention may be formed by other processes, such as thermoforming processes or injection molding, as long as the angle of the decorative border of the decorative cover is controlled in the manner as set forth herein, and as long as the length of the decorative border of the decorative cover is sufficient to support and cushion the leaves, petioles and flowers of the plant having substantial horizontal growth disposed therein without damage thereto.

Changes may be made in the embodiments of the invention described herein, or in parts or elements of the embodiments described herein, or in the sequence of steps of the methods described herein, without departing from the spirit and/or scope of the invention as defined in the following claims.

What is claimed is:

1. A decorative assembly, comprising:

a plant having substantial horizontal growth, the plant having leaves and petioles and disposed in a flower pot having an upper end; and a collar for supporting leaves and petioles of a plant having substantial horizontal growth so as to prevent damage thereto, the collar having a lower end, an upper end, an opening through a portion thereof and a length extending between the upper and lower ends thereof, a lower portion of the collar being disposed near the upper end of the flower pot and the collar extending upwardly and outwardly at an angle with respect to the upper end of the flower pot, the length of the collar being at least equal to the length of at least some of the leaves and petioles of the plant such that when the leaves and petioles of the plant are positioned on the collar, the angle of the collar relative to a horizontal axis of the flower pot decreases so that the collar moves toward a compressed condition wherein the angle of the collar relative to a horizontal axis of the flower pot is in a range of from about 25° to about 40°, thereby permitting the collar to resiliently hold and gently support the individual leaves and petioles of the plant to prevent damage thereto and to accommodate horizontal growth of the leaves and petioles of the plant.

2. A decorative assembly, comprising:

a plant having substantial horizontal growth, the plant having leaves and petioles and disposed in a flower pot having an upper end; and a collar for supporting leaves and petioles of a plant having substantial horizontal growth so as to prevent damage thereto, the collar having a lower end, an upper end, an opening through a portion thereof and a length extending between the upper and lower ends thereof, the collar being bondingly connected to the flower pot, a lower portion of the collar being disposed near the upper end of the flower pot and the collar extending upwardly and outwardly at an angle with respect to the upper end of the flower pot, the length of the collar being at least equal to the length of at least some of the leaves and petioles of the plant such that when the leaves and petioles of the plant are positioned on the collar, the angle of the collar relative to a horizontal axis of the flower pot decreases so that the collar moves toward a compressed condition, thereby permitting the collar to resiliently hold and gently support the individual leaves and petioles of the plant to prevent damage thereto and to accommodate horizontal growth of the leaves and petioles of the plant.

3. A method of using a collar with a plant having substantial horizontal growth, the method comprising the steps of:

providing a plant having substantial horizontal growth, the plant having leaves and petioles, the plant contained within a flower pot having an upper end and an outer peripheral surface;

providing a collar for supporting leaves and petioles of a plant having substantial horizontal growth so as to prevent damage thereto, the collar having a lower end, an upper end, an opening through a portion thereof and a length extending between the upper and lower ends thereof;

disposing the collar about the flower pot such that a lower portion of the collar is disposed near the upper end of the flower pot and the collar extends upwardly and outwardly at an angle with respect to the upper end of the flower pot, the length of the collar being at least equal to the length of at least some of the leaves and petioles of the plant; and positioning and arranging the leaves and petioles of the plant on the collar such that the angle of the collar relative to a horizontal axis of the flower pot decreases to an angle in a range of from about 25° to about 40° so that the collar moves toward a compressed condition, thereby permitting the collar to resiliently hold and gently support the individual leaves and petioles of the plant to prevent damage thereto and to accommodate horizontal growth of the leaves and petioles of the plant.

4. A method of using a collar with a plant having substantial horizontal growth, the method comprising the steps of:

providing a plant having substantial horizontal growth, the plant having leaves and petioles, the plant contained within a flower pot having an upper end and an outer peripheral surface;

providing a collar for supporting leaves and petioles of a plant having substantial horizontal growth so as to prevent damage thereto, the collar having a lower end, an upper end, an opening through a portion thereof and a length extending between the upper and lower ends thereof;

disposing the collar about the flower pot and bondingly connecting the collar to the flower pot such that a lower portion of the collar is disposed near the upper end of the flower pot and the collar extends upwardly and outwardly at an angle with respect to the upper end of the flower pot, the length of the collar being at least equal to the length of at least some of the leaves and petioles of the plant; and positioning and arranging the leaves and petioles of the plant on the collar such that the angle of the collar relative to a horizontal axis of the flower pot decreases so that the collar moves toward a compressed condition, thereby permitting the collar to resiliently hold and gently support the individual leaves and petioles of the plant to prevent damage thereto and to accommodate horizontal growth of the leaves and petioles of the plant.

* * * * *